US006026973A

United States Patent [19]

Der Kinderen

[11] Patent Number: 6,026,973

[45] Date of Patent: Feb. 22, 2000

[54] DOUBLE ROLLABLE STORING OR PACKING DEVICE

[75] Inventor: Johannes Martinus Petrus Der Kinderen, DC Geldermalsen, Netherlands

[73] Assignee: Vandermolen B.V., Nieuwegein, Netherlands

[21] Appl. No.: 09/073,391

[22] Filed: May 5, 1998

[51] Int. Cl.[7] ..... B65D 25/04

[52] U.S. Cl. ..... 220/520; 220/4.01; 206/748; 206/372

[58] Field of Search ..... 220/520, 4.23, 220/4.01, 4.03; 206/372, 748

[56] References Cited

U.S. PATENT DOCUMENTS

| | | | |
|---|---|---|---|
| 2,718,447 | 9/1955 | Wright | 220/520 |
| 2,936,066 | 5/1960 | Meksula | 220/520 |
| 3,317,097 | 5/1967 | Giordano | 220/520 |
| 3,459,327 | 8/1969 | Harris | 220/520 |
| 3,598,301 | 8/1971 | Shaw | 220/520 |
| 4,139,093 | 2/1979 | Holmes | 220/4.23 |
| 4,234,080 | 11/1980 | Gellert . | |
| 4,320,846 | 3/1982 | Meyering et al. . | |
| 4,998,616 | 3/1991 | Hillinger | 220/520 |
| 5,676,253 | 10/1997 | Hsu | 220/520 |
| 5,676,274 | 10/1997 | Green et al. | 220/520 |

*Primary Examiner*—Joseph M. Moy
*Attorney, Agent, or Firm*—Dority & Manning

[57] ABSTRACT

A device for storing or packing loose objects comprising a plurality of container elements, each having a bottom wall, upstanding side and end walls, and an open upper side, which elements are connected to one another by hinge joints arranged between the side edges of the bottom walls thereof to form a continuous row of elements having a first end and a second end and which elements are so shaped and dimensioned that this row of elements, from its extended position and starting from said first end and said second end, can be spirally rolled up into tow adjacently positioned blocks of prismatic form in which the open upper element sides are closed off by wall portions of other elements lying inwardly thereof in said blocks and engaging said open sides. Said blocks are interconnected through an intermediate portion of said row of elements.

6 Claims, 3 Drawing Sheets

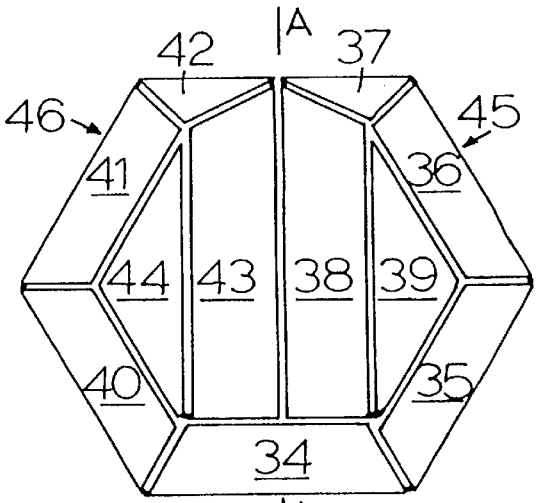
fig. 3
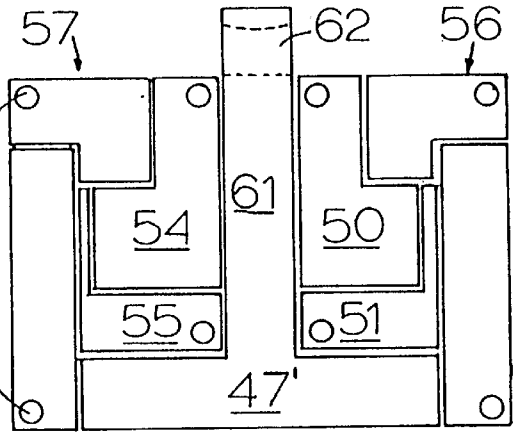
fig. 7
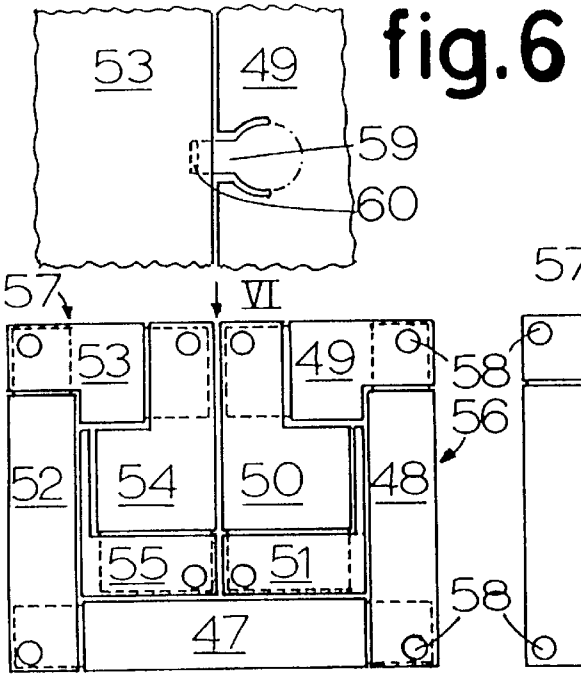
fig. 4
fig. 6
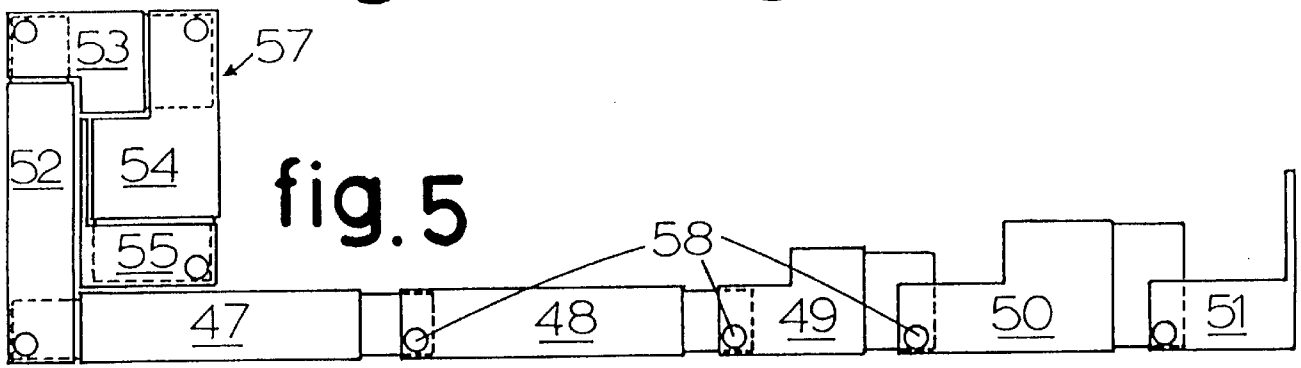
fig. 5

DOUBLE ROLLABLE STORING OR PACKING DEVICE

BACKGROUND OF THE INVENTION

The invention relates to a device for storing or packing loose objects. More particularly, the invention relates to a storing or packing device of the kind comprising a plurality of substantially rigid container elements including a bottom wall having substantially parallel side edges, and end walls and side walls extending upwardly from said bottom wall, said end walls and side walls of said elements having upper edges defining an element upper side, and hinge means hingedly interconnecting said plurality of container elements so as to form a unitary continuous row of said elements.

U.S. Pat. No. 4,320,846 issued to Meyering et al. discloses one such multiple-compartment storing or packing device. The device is provided with a row of hingedly interconnected container elements having a first end and a second end and said element row being movable between a first extended open position in which said container elements rest on their bottom walls with said element upper sides turned upwardly, and a second, rolled-up closed position in which said element row, starting from said first end thereof has been spirally rolled up from said first position to form a substantially closed block of prismatic shape comprising polygonal convolutions and in said block, each element, except for said first element, with a side turned towards said first element, is in abutting relation to the adjacent element hingedly connected thereto, and in said block, each of said majority of elements of varying widths has its said upper side matingly engaged and covered by at least one predetermined wall portion of corresponding size of at least one element situated radially inwardly thereof.

The container elements of Meyering et al. storing device all are sequentially positioned in the prismatic block. When one desires access to an element positioned near the first end of said row of elements, it is obligatory to completely or nearly completely unroll the prismatic block. However, in the completely unrolled first extended open position in which the container elements rest on their bottom walls, the device has large dimensions and as such it may be difficult to find a space large enough to provide for the complete unrolling or nearly complete unrolling of the known device. Further handling the prior art device for gaining access to an element positioned near the first end of said row of elements is rather awkward, especially when a support for the device during unrolling, such as a table top, is not present. Also, unrolling the device in order to make such an element near said first end accessible is time consuming and labor intensive.

SUMMARY OF THE INVENTION

It is an object of the present invention to overcome the aforementioned shortcomings associated with the prior art.

This object is achieved by providing a device for storing or packing loose objects, comprising a plurality of substantially rigid container elements of equal length and of varying width. Each of said elements includes a bottom wall having substantially parallel side edges, and end walls and side walls extending upwardly from said bottom wall. Said end walls and side walls of said elements have upper edges defining the element upper side. Hinge means are provided hingedly interconnecting said plurality of container elements so as to form a unitary continuous row of said elements.

Said row of hingedly interconnected container elements has a first end and a second end and said element row is movable between a first extended open position in which said container elements rest on their bottom walls with said element upper sides turned upwardly, and a second, rolled-up closed position in which said element row, starting from said first end and said second end thereof has been spirally rolled up towards an intermediate portion of said row of interconnected elements from said first position to form two substantially closed blocks of prismatic shape. These two blocks each comprises polygonal convolutions and are interconnected through said intermediate portion of said row of interconnected elements. In said blocks each element, except for said first element, with a side turned towards said first element, is in abutting relation to the adjacent element hingedly connected thereto. Further, in said blocks each of said majority of elements of varying widths has its said upper side matingly engaged and covered by at least one predetermined wall portion of corresponding size of at least one element situated radially inwardly thereof.

Thus a storage and packing device is obtained in which the row of elements in the second rolled-up position defines two spirally rolled-up prismatic blocks connected to each other, yet separately unrollable for obtaining access to the elements within said block. Each element may be exposed without fully unrolling the device, thus providing a device which is still compact while offering access to its container elements. Handling of the novel device is simpler; access to the elements is faster and less labor intensive.

In a preferred embodiment of the device according to the invention, at least one of the elements of said first spirally rolled-up prismatic block, preferably in the second position of the element row, engages at least one of the elements of said second spirally rolled-up prismatic block. Further, an embodiment may be realized, in which said first spirally rolled-up prismatic block is a mirror image of said second spirally rolled-up prismatic blocks.

In yet another embodiment of the novel device a hand-grip means is provided connected to said intermediate portion of said row of interconnected elements for carrying the device in its first extended open position as well as in its second rolled-up closed position. Said hand-grip means may be of substantially equal length as the rigid container elements and, starting from said intermediate portion, extends upwardly such as to be positioned in between and to engage said first and second prismatic blocks when in their spirally rolled up positions.

Further the provision of releasable locking means is envisaged operating on each of said first and second spirally rolled-up prismatic blocks to prevent accidental unrolling of said blocks in the rolled-up state thereof.

BRIEF DESCRIPTION OF THE DRAWINGS

The invention will be more readily understood and the further objects and advantages thereof will be more apparent when read in conjunction with the accompanying drawings showing preferred embodiments of the invention. In the drawings:

FIG. 3 is an end view of an embodiment of the device according to the invention in the rolled-up state thereof;

FIG. 4 is an end view of another embodiment of the device according to the invention in the rolled-up state thereof;

FIG. 5 is an end view of the device of FIG. 4 in a partly unrolled state thereof;

FIG. 6 is a partially top plan view of the device of FIG. 4, viewed in the direction indicated by arrow VI in FIG. 4; and FIG. 7 is an end view of still another embodiment of the device according to the invention in the rolled-up state thereof.

DETAILED DESCRIPTION

Figure 1:
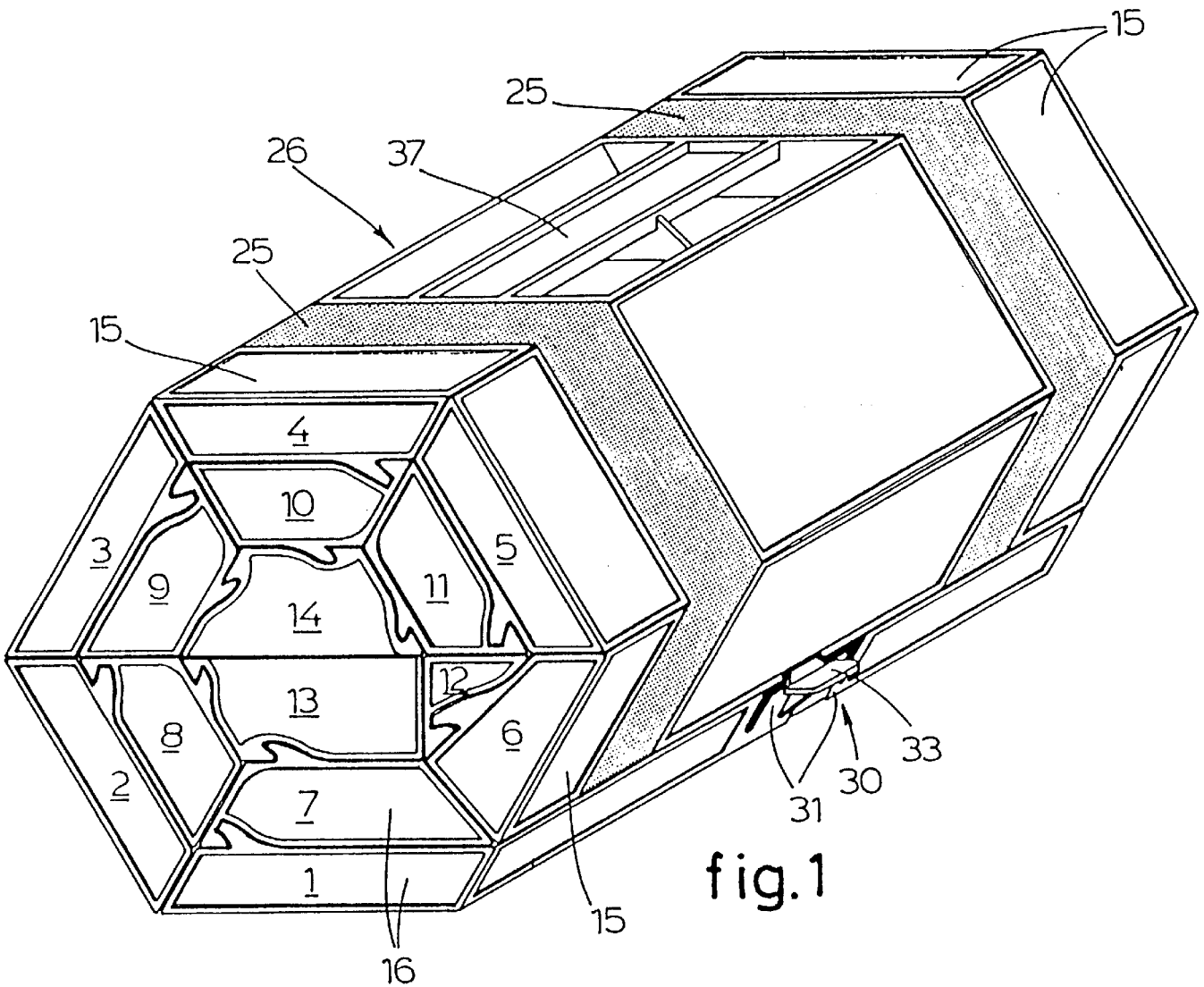
fig.1 PRIOR ART
FIG. 1 is a perspective view of a state of the art embodiment of a storing and packing device forming a storage box which, in the rolled-up state, has the shape of a regular hexagonal prismatic block.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a further embodiment. Such modifications and variations are within the scope and spirit of the invention.

In the following description, firstly, a state of the art storing and packing device will be described, illustrating features which apply generally for devices of the type to which the invention refers.

Figure 2:
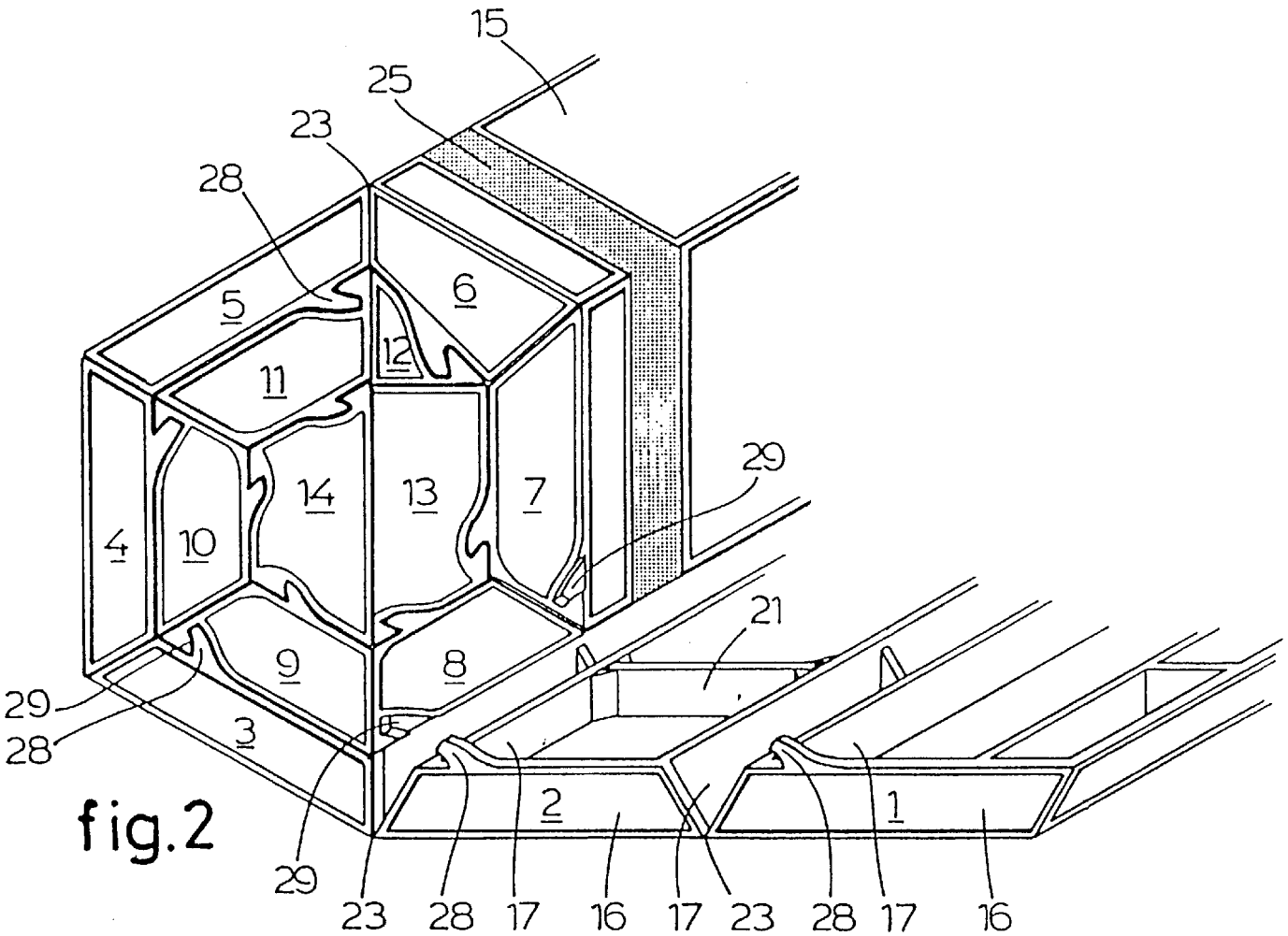
fig.2 PRIOR ART
FIG. 2 is a perspective view of the box of FIG. 1 in a partly unrolled state.

The state of the art storage box illustrated in FIGS. 1 and 2 comprises a row of mutually hinge-connected oblong container elements 1–14 of equal length but of differing cross-sections. The container elements each have a flat rectangular bottom wall 15 and end walls 16 extending vertically upward therefrom, which end walls determine the different basic sectional forms of the container elements. The sectional form of the container elements 1–14 differs, as appears readily from FIG. 1 or FIG. 2. The container elements are open on their upper sides and have vertical side walls 17 which connect at the upper corner points of the end walls 16 and consequently join the bottom walls 15 at a short distance from the side edges thereof. The container elements may be divided longitudinally into compartments by vertical cross-partitions 21.

The container elements 1–13 are hingeably joined to one another at adjoining longitudinal edges of the side walls 17 thereof by suitable hinge connections, some of which are indicated by 23. Through this arrangement, the container elements are successively linked together to form a continuous row thereof. In the illustrated known embodiment, the hinge connections between the container elements are constituted by flexible strips 25 (FIGS. 1 and 2), said strips run parallel to one another across the undersides of the bottom walls 15 of the container elements in recesses provided therefor in the latter and to which they are adhesively fixed.

The transverse dimensions and sectional forms of the container elements 1–14 or the end walls 16 thereof, respectively, are chosen such that an initially linearly extended row of container elements can be rolled up spirally into the form of a closed block 26 of regular hexagonal prismatic form as illustrated in FIG. 1.

For proper functioning of the described storage box, it is of importance that, during unrolling of the block, the spiral windings of the as yet unrolled portion of the block cannot prematurely open and that during rolling up of the row of container elements, the already rolled up container elements cannot again move away from one another. In order to prevent this premature opening, a curved projection or detent 28 is formed on the upper edges of each of the end walls 16 of the container elements, said detent 28 extends obliquely upwardly in the direction in which the row of container elements is unrolled and said detent 28, in the rolled-up position of the row, is fittingly received in a recess or groove 29 formed in the underside of the corresponding end wall 16 of the container element situated radially inwardly thereof. From FIG. 2 it will be seen that the detents 28 and grooves 29 between the other container elements of the still rolled up portion of the block hold such container elements together and effectively prevent the premature opening of the spiral windings.

A snap closure 30 is formed in the center of the outwardly directed side wall 18 of the outermost container element 1 of the row of elements. To this end, the side wall 18 is provided with notches extending downwardly from the upper edge thereof to form resilient lips 31 connected at their lower ends to the bottom wall 15 of the container element 1. These lips 31 support an inwardly extending hook portion (not shown) and a sideways extending finger-grip 33. The hook portion extends into an opening in the edge of the bottom wall 15 of the container element 7 and, in its closed condition, grips over a thickened edge portion of this opening. By pushing the grip 33 down with a finger, the lips 31 can be resiliently bent to lift the hook portion from the edge portion, so that the box can be opened to unroll the container elements.

A hand grip 36 is formed in the container element 4 which lies opposite the outermost container element 1 in the rolled-up block 26. If the closed block-shaped box 26 is picked up by the hand grip 37 to carry the same and is then again put down, it will thus automatically come to rest on the outermost container element 1 in the correct position for opening the box and unrolling the container elements thereof.

For a more detailed description of the state of the art device, reference is made to U.S. Pat. No. 4,320,846, the subject matter of which is incorporated herein by reference.

When seeking access to the contents of one of the innermost container elements, such as 13 or 14, the row of mutually connected container elements has to be completely unrolled.

It is to be noted that in the following description of preferred embodiments of the storing and packing device according to the invention, only those features will be shown and discussed which are considered to be essential for the inventive concept. However, these preferred embodiments of the storing and packing device may be provided with elements which correspond with like elements of the state of the art device described above. Especially, cooperating projections or detents and grooves corresponding with the state of the art projections or detents 28 and grooves 29, flexible strips defining the hinge connections between the container elements corresponding with the state of the art flexible strips 25 and snap closures corresponding to the state of the art snap closures 30 may be provided, although amended, if needed, to be applicable to an inventive device, as will be readily apparent to those skilled in the art. For a proper understanding of the invention it suffices, that the novel devices are shown only in an end view illustrating the shape of, and relation between, the container elements constituting the storing and packing device.

The device illustrated in FIG. 3 is constructed in accordance with the inventive concept. It comprises a row of mutually hinge-connected oblong container elements 34–44 of equal length but of differing cross-section. As appears clearly, the device is constructed symmetrically about a plane indicated as A—A. Starting from an intermediate container element 34, two identical, but mirror image, rows of mutually hinge-connected container elements are defined, i.e., right from plane A—A a row comprising elements 34–39, and left from plane A—A a row comprising elements 34, 40–44. Thus, at both sides of plane A—A two substantially closed blocks 45 and 46 of prismatic shape are defined, each comprising polygonal convolutions, said blocks 45 and 46 are interconnected through the intermediate element 34 of said row of interconnected elements.

For exposing the contents of one of the innermost container elements, for example container element 38 or 39, the device does not need to be unrolled completely, as applies for the state of the art device illustrated in FIGS. 1 and 2. Now only one of said two prismatic blocks, specifically said block 45 containing the container elements 38 and 39, needs to be unrolled, whereas the other prismatic block 46 remains in its rolled-up state. Thus, the dimensions of the device in this partly unrolled state are moderate compared to the device according to the state of the art. This improves the handling properties of the novel device. Of course it is still possible to unroll both blocks 45 and 46 simultaneously, if needed.

While the device illustrated in FIG. 3 is of hexagonal shape, the inventive devices shown in FIGS. 4–7 are of rectangular shape. It is to be understood, however, that the cross-sectional shape of the inventive device is not limited to these specific shapes, but may be varied widely while still applying the inventive principles. Further, it is noted that it is not necessary that both blocks of a device (for example, blocks 45 and 46 of the device illustrated in FIG. 3) need to be symmetrical or mirror images. The inventive principles will also apply to devices incorporating two blocks which are differently shaped.

Referring now to FIG. 4, the rectangular device again comprises a row of mutually hinge-connected container elements 47–55. These container elements are arranged in two blocks 56 and 57 which, respectively, comprise the elements 47–51 and 47, 52–55. Whereas the hinge connections of the device of FIG. 3 will be constituted by flexible strips as described with respect to the state of the art device, in this specific case, said hinge connections are shaped as pivot axes 58. It is to be understood, however, that other hinge connections may be applicable without departing from the scope of the invention as defined by the appending claims.

FIG. 5 shows the device of FIG. 4 in a partly unrolled state, such that the prismatic block 56 is unrolled to expose the contents of the container elements 47–51, whereas the prismatic block 57 remains in its rolled up state. It is noted, however, that it is also possible to totally unroll the device, or to only unroll the other prismatic block 57.

A snap closure (FIG. 6) is formed for keeping the device in the rolled upstate. To this end, container elements 49 is provided with a resilient lip 59, ending in a hook-like extension 60. When rolling up the device, said hook-like extension 60 will engage behind a recess (not illustrated) defined in the adjoining container element 53, such as to hold together blocks 56 and 57. By pushing the lip 59 down with a finger, the lip 59 can be resiliently bent to disengage the hook-like extension 60 from said recess, so that the device can be opened to unroll at least one of said blocks 56 or 57.

Finally, FIG. 7 illustrates an embodiment of the novel device which basically corresponds with the device shown in FIG. 4. Thus, corresponding items will have the same reference numbers. In the device according to FIG. 4, the blocks 56 and 57 directly engage each other, i.e., the corresponding container elements 50 and 54 and the corresponding container elements 51 and 53 face each other, and may even contact each other. In the embodiment illustrated in FIG. 7, however, the intermediate container element 47' is provided with an extension 61 ending in a hand-grip means 62. The extension is positioned in between and engages said first and second prismatic blocks 56 and 57 when in their spirally rolled-up positions. In the illustrated embodiment the extension 62 and hand-grip means 62 both are substantially of equal length as the oblong rigid container elements 48–55. Snap closures (not shown) may be provided which basically correspond with the snap closure illustrated and described in FIG. 6. In this case, however, the extension 61 may be provided with recesses (not shown) cooperating with resilient lips and hook-like extensions of each of the adjoining container elements 49 and 53.

Using the hand-grip means 62, the device may be carried by a user while in the rolled-up state (illustrated in FIG. 7). To this end, the hand-grip means 62 projects upwardly beyond the upper limits of the first and second prismatic blocks 56 and 57. However, also in a partly unrolled state (for example, corresponding to FIG. 5) or even in a completely unrolled state (both blocks 56 and 57 totally unrolled), the hand-grip 62 allows a user to carry the device. It is to be noted, however, that in the case where the device is carried in the partly or completely unrolled state, measures may be taken to ensure that the rows of consecutive container elements cannot unroll beyond the position illustrated in FIG. 5. This means that, starting from the position shown in FIG. 5, the hinge connections 58 only allow a rotation of the container elements in the sense of rolling up, and do prevent a further rotation in the opposite direction.

While the invention has been illustrated and described with reference to specific embodiments thereof, it will be understood that other embodiments may be envisaged within the scope of the following claims.

It should be appreciated by those skilled in the art that various modifications and variations can be made in the present invention without departing from the scope and spirit of the invention. It is intended that the present invention include such modifications and variations as come within the scope of the appended claims and their equivalents.

I claim:

1. A device for storing or packing objects, comprising:

a plurality of connected substantially rigid container elements wherein said container elements include a bottom wall;

a plurality of side walls connected to said bottom wall, wherein said side walls define an open upper side; and pivotal connections which join adjacent said container elements;

wherein said container elements form a continuous unitary row of container elements movable between an extended position wherein said container elements are generally oriented in a flat position so that said open upper side is exposed, and a dual block position of a polygonal shape wherein said container elements are coiled into two blocks so that at least one intermediate container element forms a base on which each block rests; and wherein in said dual block position said open upper side of said container elements are covered by at least one wall of a radially interior container element.

2. The device for storing or packing items as in claim 1, wherein at least one said container element is operably configured with a snap-closure mechanism.

3. The device for storing or packing items as in claim 1, wherein said polygonal shape is prismatic.

4. The device for storing or packing items as in claim 1, wherein said polygonal shape is rectangular.

5. A device for storing or packing objects, comprising:

a plurality of connected substantially rigid container elements wherein said container elements include a bottom wall;

a plurality of side walls connected to said bottom wall, wherein said side walls define an open upper side; and pivotal connections which join adjacent container elements;

wherein said container elements form a continuous unitary row of container elements that are movable between an extended position wherein said elements are generally oriented in a flat position so that said open upper side is exposed, and a dual block position of a polygonal shape wherein said blocks are formed by container elements which are coiled so that said open upper side of said container element is covered by at least one wall of a radially interior container element; and a snap-closure formed on said container elements so that the device for storing or packing will remain in a rolled-up state.

6. The device for storing or packing items as in claim 5, wherein at least one said container element is operably configured with a locking mechanism to maintain said dual block position.

* * * * *